US006887185B1

(12) United States Patent
Kuo

(10) Patent No.: US 6,887,185 B1
(45) Date of Patent: May 3, 2005

(54) TREADMILL HAVING A CUSHIONED DECK LIMITING DEVICE

(76) Inventor: Hai Pin Kuo, No. 158, Sec. 1, Er Jen Road, Jen Teh Hsiang, Tainan Hsien (TW), 717

( * ) Notice: Subject to any disclaimer, the term of this patent is extended or adjusted under 35 U.S.C. 154(b) by 155 days.

(21) Appl. No.: 09/625,214

(22) Filed: Jul. 24, 2000

(51) Int. Cl.[7] ..... A63B 22/00
(52) U.S. Cl. ..... 482/54
(58) Field of Search ..... 482/54, 51

(56) References Cited

U.S. PATENT DOCUMENTS 5,007,630 A * 4/1991 Real et al. ..... 482/54
5,279,528 A 1/1994 Dalebout et al. ..... 482/54
5,336,144 A * 8/1994 Rodden ..... 482/54
5,441,468 A * 8/1995 Deckers et al. ..... 482/54
5,454,772 A * 10/1995 Rodden ..... 482/54
5,673,930 A * 10/1997 Coleman ..... 280/728.2
5,976,061 A * 11/1999 Moon et al. ..... 482/54
6,589,138 B2 * 7/2003 Dyer et al. ..... 482/54

* cited by examiner

*Primary Examiner*—Stephen R. Crow
(74) *Attorney, Agent, or Firm*—Charles E. Baxley

(57) ABSTRACT

A treadmill includes a base frame having an endless trained about the forward and rearward rollers. A deck is disposed between the base frame and the upper run of the belt. One or more cushioning members are disposed between the peripheral portion of the deck and the base frame to absorb impact loads imparted on the deck by users. One or more stop barrels are secured on the base frame and slidably and loosely received in the respective openings or sleeves of the deck to limit the relative lateral movement between the deck and the cushioning member and the base frame.

7 Claims, 7 Drawing Sheets

TREADMILL HAVING A CUSHIONED DECK LIMITING DEVICE

BACKGROUND OF THE INVENTION

1. Field of the Invention

The present invention relates to an exerciser, and more particularly to an exercise treadmill having a device for limiting the movement of the cushioned deck relative to base frame thereof and for preventing the deck from being disengaged from the cushioning member and the base frame.

2. Description of the Prior Art

Typical treadmills comprise a base frame supported on a supporting surface or the ground, a pair of transverse forward and rearward roller assemblies mounted in the base frame, and an endless belt trained about the forward and rearward roller assemblies. A deck is disposed and positioned between the base frame and the upper run of the belt. The treadmills may include a handle support for supporting one or more handles thereon and for supporting the upper portion of the user, and may include a motor driving device for driving the endless belt. Some of the exercisers include a cushioning device for resiliently supporting the deck and for absorbing the shocks and vibrations or impact loads acted onto the deck by the users. U.S. Pat. No. 5,279,528 to Dalebout et al., discloses one of the exercisers having a cushioning device for resiliently supporting the deck. However, no devices have been provided to limit the lateral movement of the cushioned deck relative to the base frame.

The present invention has arisen to mitigate and/or obviate the afore-described disadvantages of the conventional exercisers.

SUMMARY OF THE INVENTION

The primary objective of the present invention is to provide a treadmill including a device for limiting the lateral movement of the cushioned deck relative to base frame thereof and for preventing the deck from being disengaged from the cushioning member and the base frame.

In accordance with one aspect of the invention, there is provided a treadmill comprising a base frame including a pair of transverse forward and rearward roller assemblies mounted therein, the base frame including a peripheral portion, an endless belt trained about the forward and rearward roller assemblies and including an upper run, a deck including a peripheral portion disposed between the peripheral portion of the base frame and the upper run of the belt, at least one cushioning member disposed between the peripheral portion of the deck and the peripheral portion of the base frame to absorb impact loads imparted on the deck by users, and limiting means for limiting a relative lateral movement between the deck and the cushioning member and the base frame and to prevent the deck from being disengaged from the cushioning member and the base frame.

The deck includes at least one opening formed therein, the limiting means includes at least one stop member secured on the base frame and slidably received in the opening of the deck for limiting the relative lateral movement between the deck and the cushioning member and the base frame. The deck includes a sleeve engaged in the opening thereof for slidably receiving the stop member. The sleeve includes an outer thread formed thereon and engaged in the deck for solidly securing the sleeve in the deck.

The stop member is a barrel including an inner cylindrical member and an outer cylindrical member provided and secured on the inner cylindrical member. The limiting means includes a fastener engaged through the inner cylindrical member of the barrel and secured to the base frame, the outer cylindrical member is made of soft materials to absorb impact loads acting onto the barrels. The base frame includes at least one extension extended therefrom for supporting the fastener.

One or more casings are further engaged onto the peripheral portion of the deck and secured to the deck to protect the peripheral portion of the deck. The casing includes at least one channel formed therein and includes at least one flange extended inward of the channel thereof, the securing means includes a least one fastener secured on the peripheral portion of the deck and slidably received in the channel of the casing and having a head provided thereon for engaging with the flange of the casing and for securing the casing to the peripheral portion of the deck and to cover and protect the peripheral portion of the deck.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
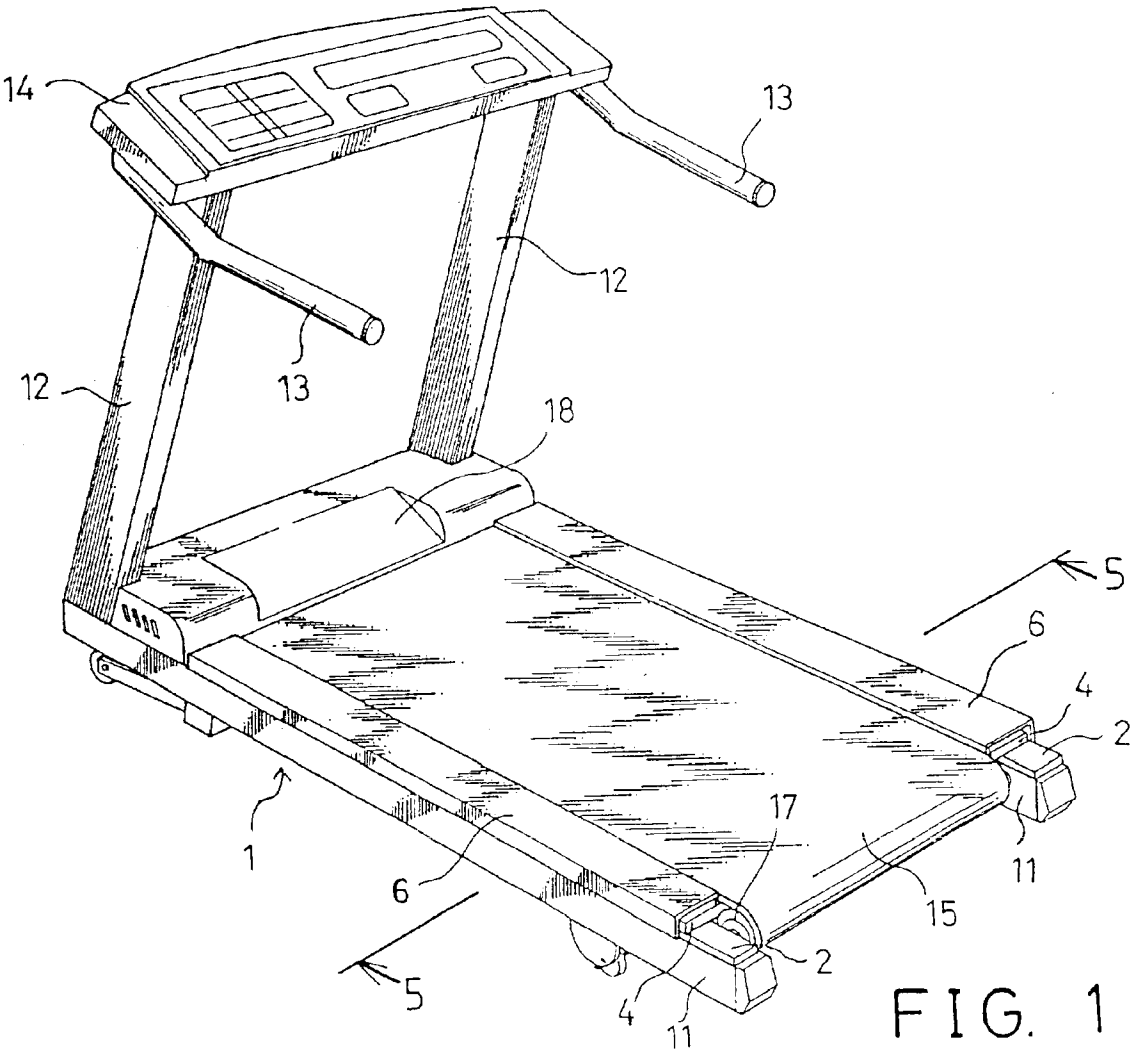
FIG. 1 is a perspective view of a treadmill in accordance with the present invention.
Figure 2:
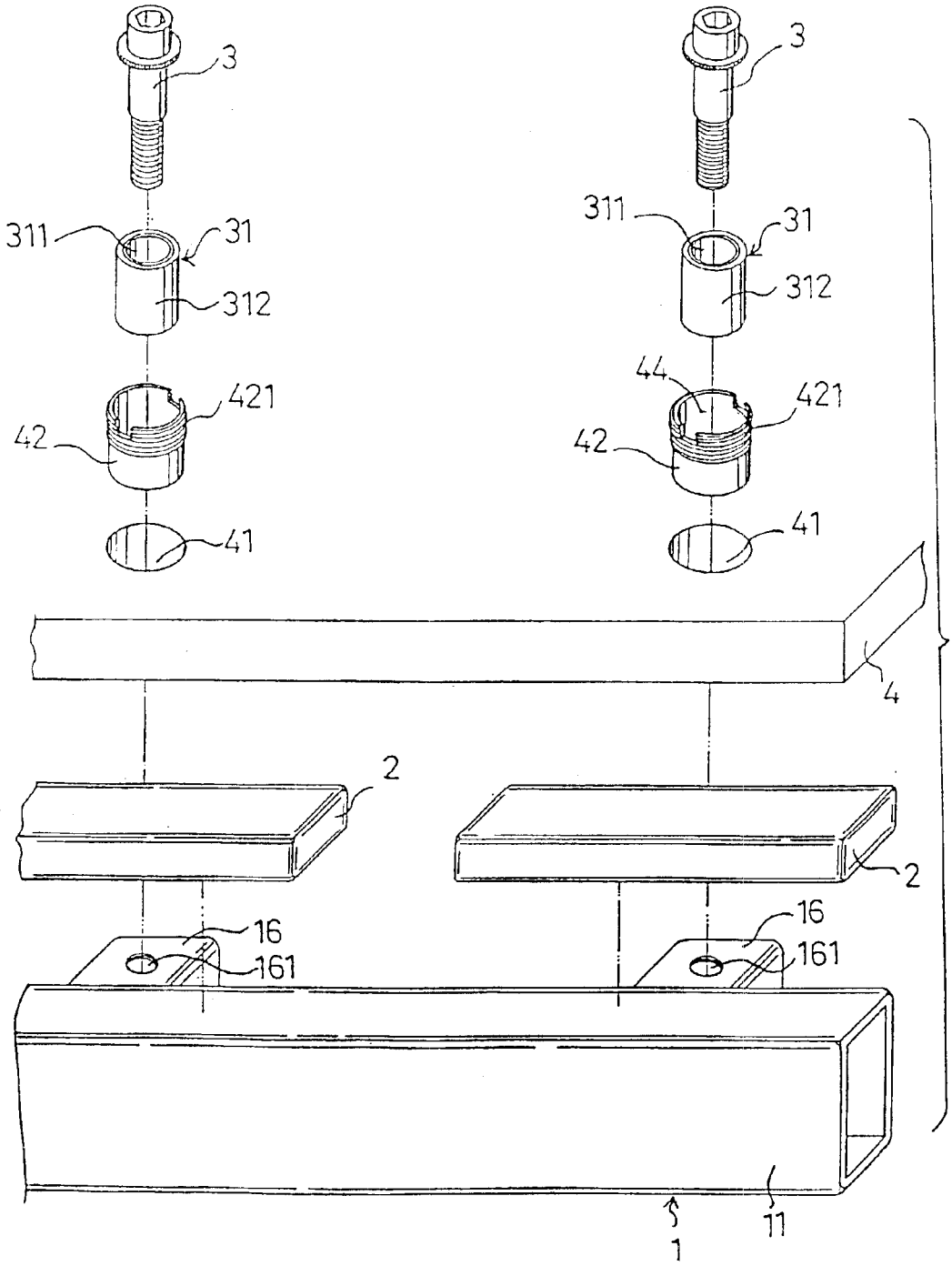
FIGS. 2, 3, 4 are partial exploded views of the treadmill.
Figure 3:
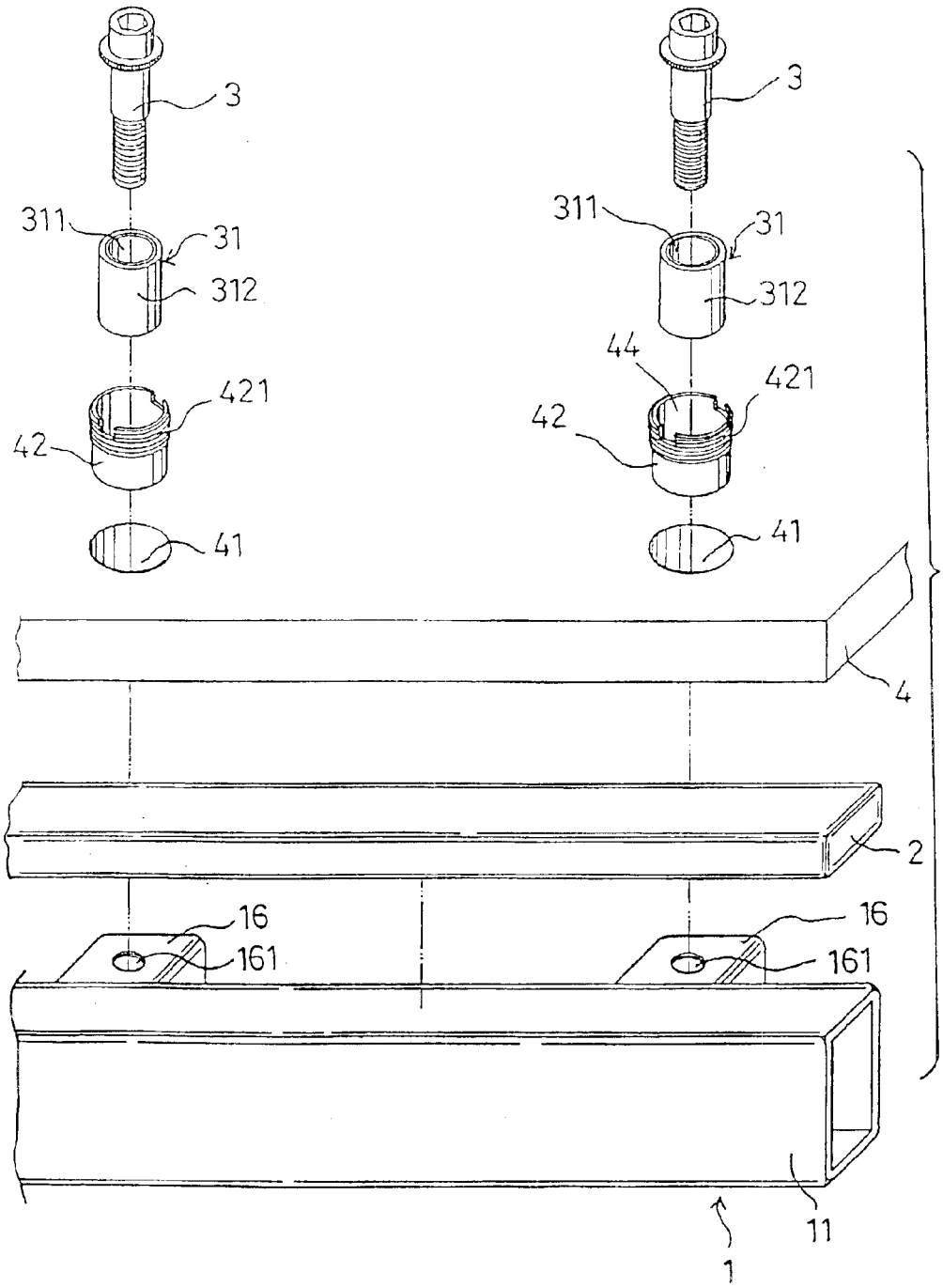

Referring to the drawings, and initially to FIGS. 1–5, a treadmill in accordance with the present invention comprises a base frame 1 including a handle support 12 upwardly extended from the front portion thereof for supporting the handles 13 and/or the displayer device 14 thereon. The base frame 1 includes a pair of transverse forward and rearward roller assemblies 17 mounted therein, preferably disposed between a pair of parallel side margins or side portions or side beams 11. An endless belt 15 is trained about the forward and rearward roller assemblies 17. A deck 4 is disposed and positioned between the beams 11 of the base frame 1 and the upper run of the belt 15. One (FIG. 3) or more (FIG. 2) cushioning members 2, such as the springs, the spongy members, the rubber tubular members etc., of a suitable stiffness are provided and disposed either along the sides of the base frame 1, particularly the beams 11 of the base frame 1, to underlie the side margins of the deck 4, or transversely of the deck 4, to absorb impact loads imparted on the deck 4 by the user. The base frame 1 includes a housing 18 provided in the front portion thereof for receiving such as the motor driving device therein. The driving motor is not related to the present invention and will not be described in further details. The treadmill in accordance with the present invention is to provide a device for limiting the lateral movement of the cushioned deck relative to base frame.

Referring to FIGS. 2, 3 and 5–9, the deck 4, particularly the peripheral portion of the deck 4, includes a number of openings 41 formed therein. A number of sleeves 42 are force-fitted in the respective openings 41 of the deck 4 and each includes an embossed outer surface or each includes an outer thread 421 formed thereon for engaging with the deck 4 and for solidly securing the sleeves 42 in the deck 4. The sleeves 42 may also be forced into the deck 4 with the threading operations. The sleeves 42 each includes a bore 44 formed therein. A number of stop members 31, such as the stop barrels 31, each includes an inner cylindrical member 311 of metal or the other high strength materials, and each includes an outer cylindrical member 312 provided or secured on the outer portion of the inner cylindrical member 311. The outer cylindrical member 312 is preferably made of rubber or plastic or the other soft materials for absorbing the impact loads of the deck 4 laterally acted onto the barrels 31. A number of fasteners 3 are threaded through the barrels 31 and secured to the beams 11 or to the base frame 1. As shown in the drawings, the beams 11 each includes one or more extensions 16 extended therefrom and having a screw hole 161 formed therein for threading with the fasteners 3 and for rotatably securing the barrels 31 to the base frame 1. The stop barrels 31 are loosely and slidably received in the sleeves 42 relatively.

Figure 4:
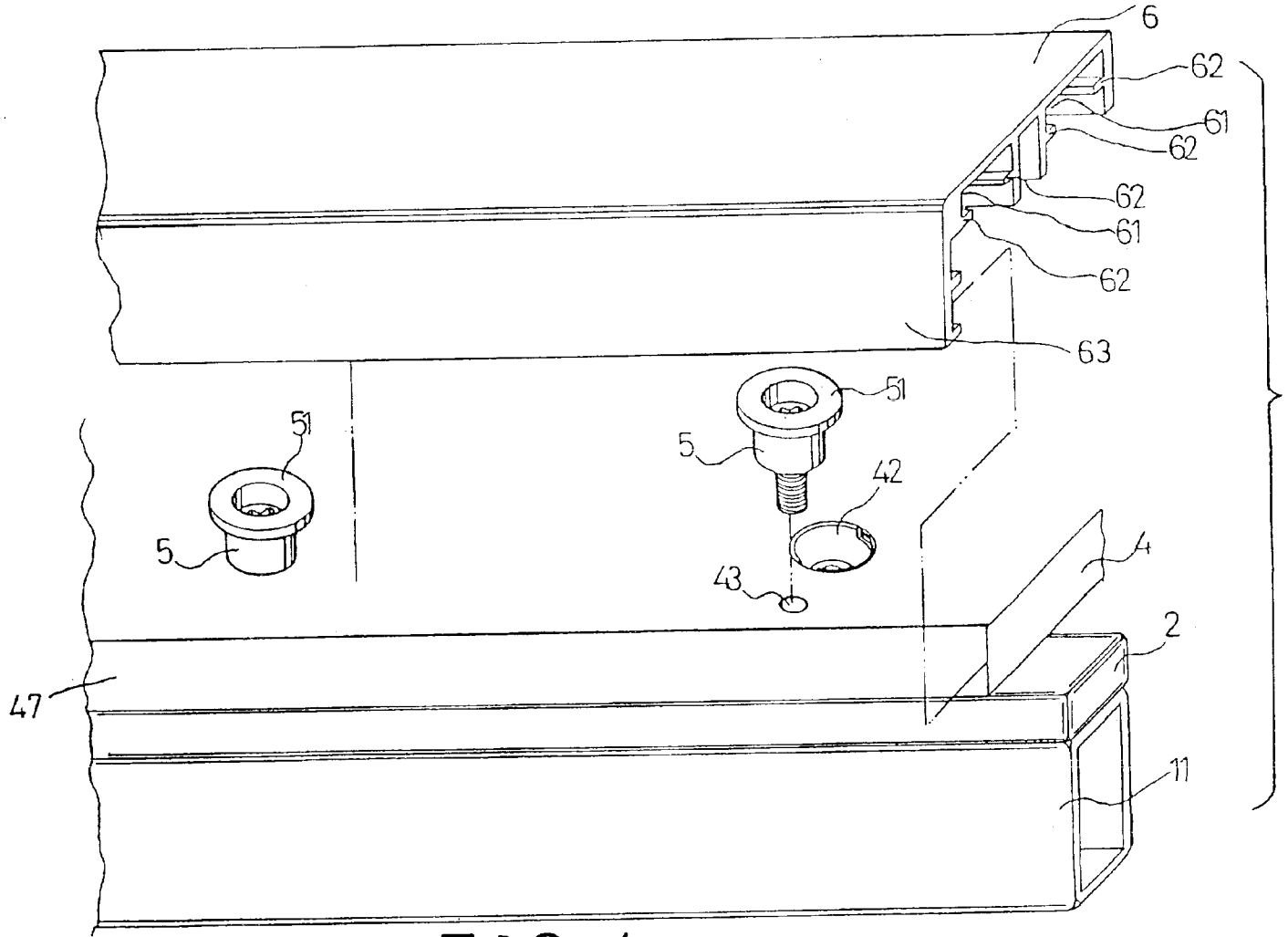
Figure 5:
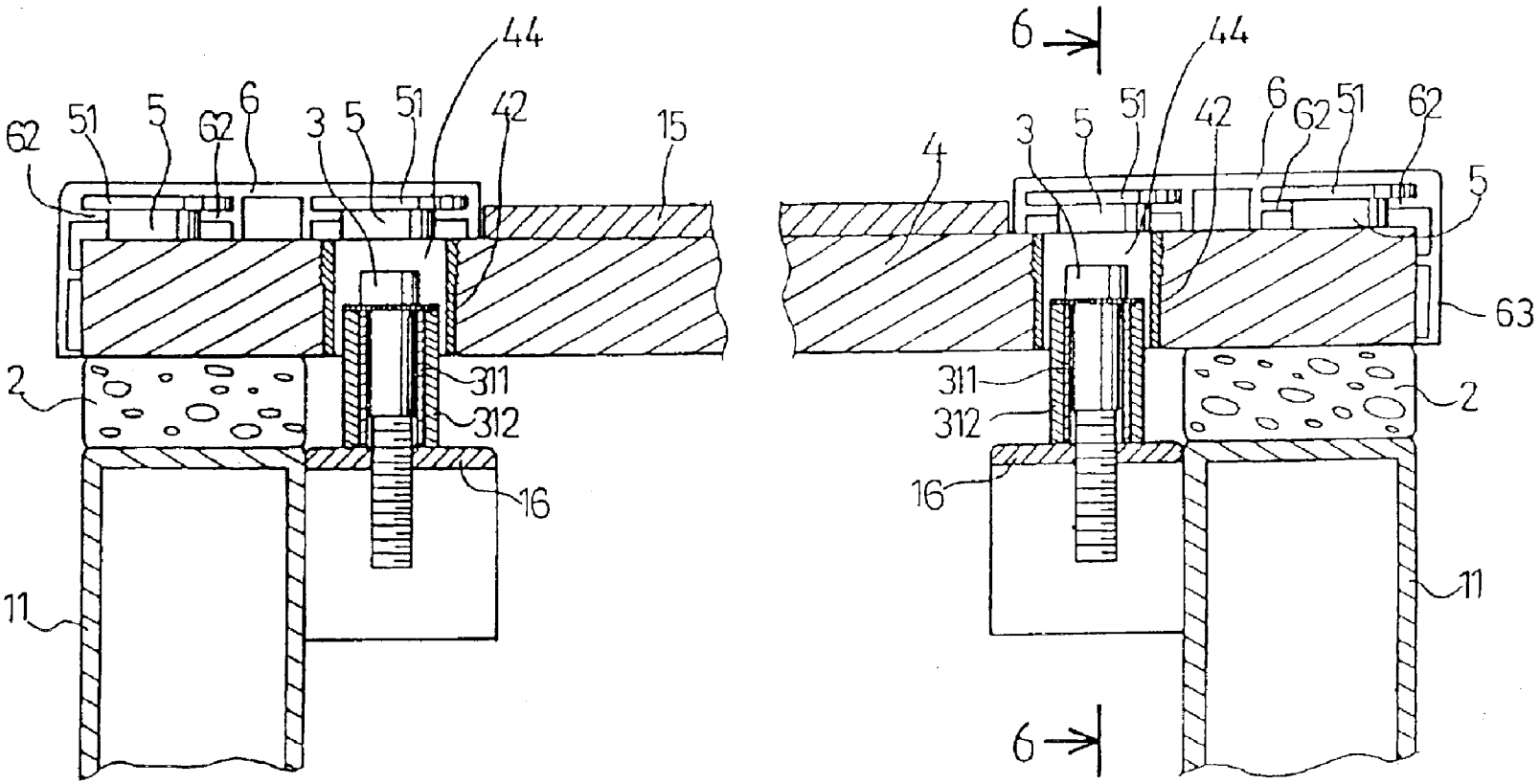
FIG. 5 is a partial cross sectional view taken along lines 5—5 of FIG. 1.

Referring again to FIGS. 1, 4 and 5, a pair of casings 6 are further provided for attaching and mounting onto the side margins or the side edges of the deck 4 for engaging with and for limiting the sidewise movement of the endless belt 15 relative to the deck 4. A number of fasteners 5 are secured to, such as threadedly secured to the screw holes 43 of the deck 4 (FIG. 4). The fasteners 5 each includes an enlarged head 51 formed on top thereof. The casings 6 each includes one or more channels 61 formed therein for slidably receiving the fasteners 5, and each includes one or more flanges 62 extended laterally inward of the respective channels 61 for engaging with the heads 51 of the fasteners 5 and for securing the casings 6 to the deck 4 and to cover and protect the side margins or side edges of the deck 4. The casings 6 each includes a panel 63 dependent downwardly therefrom for engaging with and for covering and protecting the outer peripheral surface 47 (FIG. 4) of the deck 4.

Figure 6:
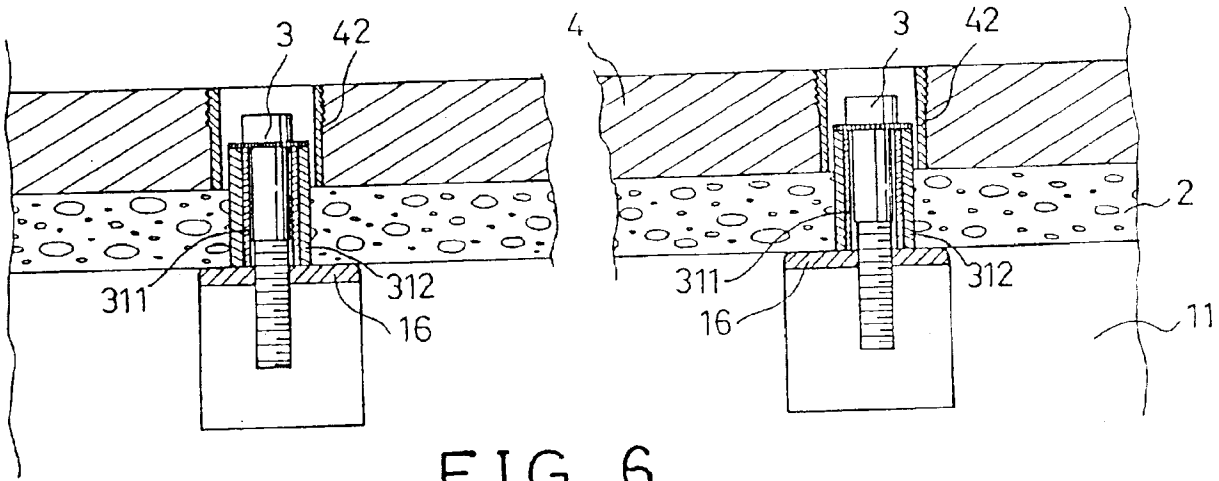
FIG. 6 is a partial cross sectional view taken along lines 6—6 of FIG. 5.
Figure 7:
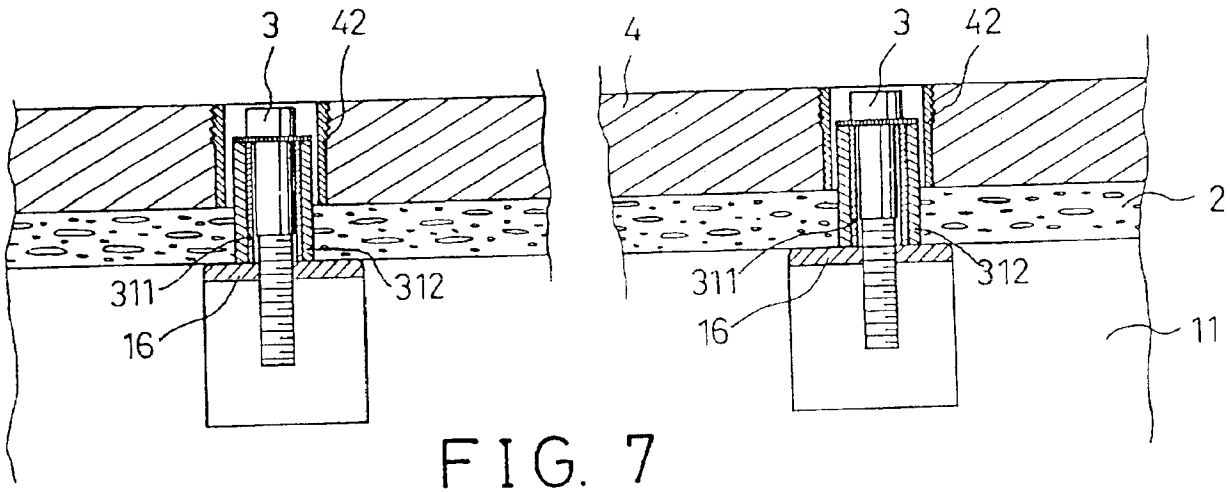
FIG. 7 is a partial cross sectional view similar to FIG. 6, illustrating the operation of the cushioned deck limiting device for the treadmill.
Figure 8:
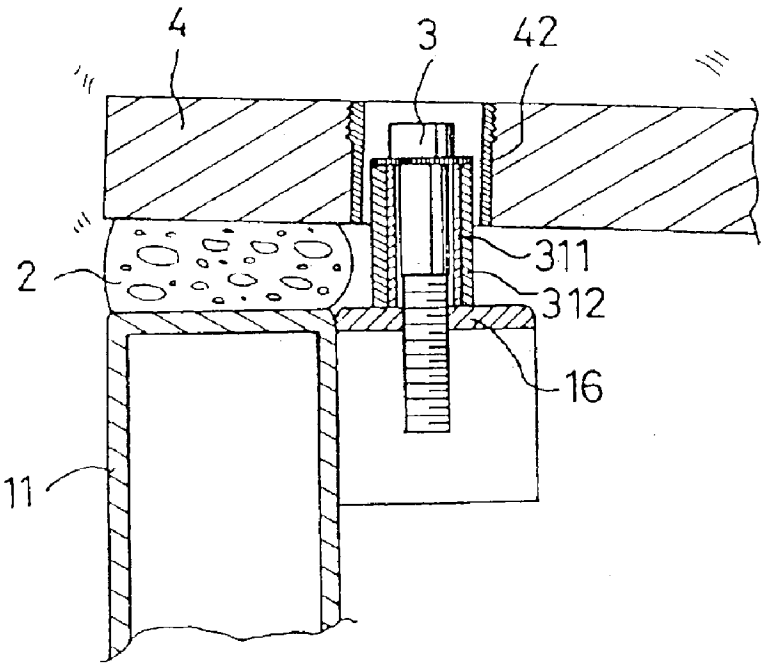
FIGS. 8 and 9 are simplified partial cross sectional views similar to FIG. 5, illustrating the operation of the cushioned deck limiting device for the treadmill.
Figure 9:
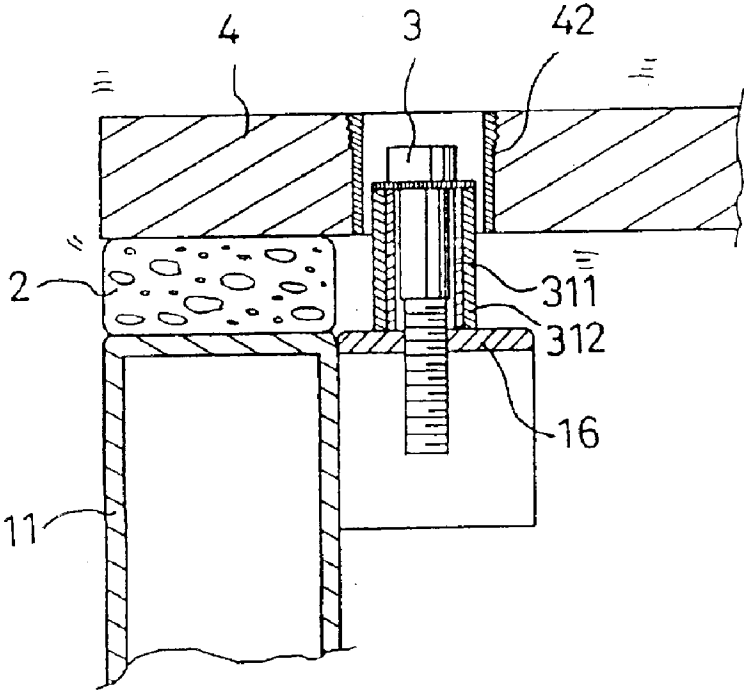

As best shown in FIGS. 5–9, in operation, the cushioning members 2 may be deformed (FIG. 7) to absorb the impact loads imparted on the deck 4 by the user. The stop barrels 31 may be slidably received in the sleeves 42 relatively (FIGS. 6, 7). In addition to the upward and downward movement of the deck 4 relative to the cushioning members 2 and the base frame 1, the deck 4 may also be shaken or moved laterally, such as forwardly or rearwardly or sidewise, relative to the cushioning members 2 and the base frame 1 (FIGS. 8, 9). The sliding engagement of the stop barrels 31 in the respective sleeves 42 may thus be used to limit the relative lateral movement between the deck 4 and the cushioning members 2 and the base frame 1, and thus to prevent the deck 4 from being disengaged from the cushioning members 2.

Accordingly, the treadmill in accordance with the present invention includes a device for limiting the lateral movement of the cushioned deck relative to base frame thereof.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A treadmill comprising:

a base frame including a pair of transverse forward and rearward roller assemblies mounted therein, said base frame including a peripheral portion, an endless belt trained about said forward and rearward roller assemblies and including an upper run, a deck including a peripheral portion disposed between said peripheral portion of said base frame and said upper run of said belt, at least one cushioning member disposed between said peripheral portion of said deck and said peripheral portion of said base frame to absorb impact loads imparted on said deck by users, limiting means for limiting a relative lateral movement between said deck and said at least one cushioning member and said base frame, at least one casing engaged onto said peripheral portion of said deck, and including at least one channel formed therein, and including at least one flange extended inward of said at least one channel thereof, and securing means for securing said at least one casing to said deck and to protect said peripheral portion of said deck, said securing means including at least one fastener secured on said peripheral portion of said deck and slidably received in said at least one channel of said at least one casing and having a head provided thereon for engaging with said at least one flange of said at least one casing and for securing said at least one casing to said peripheral portion of said deck.

2. The treadmill according to claim 1, wherein said deck includes at least one opening formed therein, said limiting means includes at least one stop member secured on said base frame and slidably received in said at least one opening of said deck for limiting the relative lateral movement between said deck and said at least one cushioning member and said base frame.

3. The treadmill according to claim 2, wherein said deck includes a sleeve engaged in said at least one opening thereof for slidably receiving said at least one stop member.

4. The treadmill according to claim 3, wherein said sleeve includes an outer thread formed thereon and engaged in said deck for solidly securing said sleeve in said deck.

5. A treadmill comprising:

a base frame including a pair of transverse forward and rearward roller assemblies mounted therein, said base frame including a peripheral portion, an endless belt trained about said forward and rearward roller assemblies and including an upper run, a deck including a peripheral portion disposed between said peripheral portion of said base frame and said upper run of said belt, said deck including at least one opening formed therein, at least one cushioning member disposed between said peripheral portion of said deck and said peripheral portion of said base frame to absorb impact loads imparted on said deck by users, and limiting means for limiting a relative lateral movement between said deck and said at least one cushioning member and said base frame, said limiting means including at least one stop member secured on said base frame and slidably received in said at least one opening of said deck for limiting the relative lateral movement between said deck and said at least one cushioning member and said base frame, and said at least one stop member being a barrel including an inner cylindrical member and an outer cylindrical member provided and secured on said inner cylindrical member.

6. The treadmill according to claim 5, wherein said limiting means includes a fastener engaged through said inner cylindrical member of said barrel and secured to said base frame, said outer cylindrical member is made of soft materials to absorb impact loads acting onto said barrel.

7. The treadmill according to claim 6, wherein said base frame includes at least one extension extended therefrom for supporting said fastener.

* * * * *